US009808069B2

(12) United States Patent
Kim et al.

(10) Patent No.: US 9,808,069 B2
(45) Date of Patent: Nov. 7, 2017

(54) PUMPING-TYPE COSMETIC CONTAINER COMPRISING SIDE BUTTON

(71) Applicant: YONWOO CO., LTD., Incheon (KR)

(72) Inventors: Hak-Chan Kim, Incheon (KR); Sung-Sin Kim, Incheon (KR); Edward F. Csaszar, Mountainside, NJ (US)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/889,099

(22) PCT Filed: Apr. 28, 2014

(86) PCT No.: PCT/KR2014/003707

§ 371 (c)(1),
(2) Date: Nov. 4, 2015

(87) PCT Pub. No.: WO2014/181987

PCT Pub. Date: Nov. 13, 2014

(65) Prior Publication Data

US 2016/0081451 A1 Mar. 24, 2016

(51) Int. Cl.
*A45D 34/04* (2006.01)
*B05B 11/00* (2006.01)

(52) U.S. Cl.
CPC ..... *A45D 34/04* (2013.01); *B05B 11/0089* (2013.01); *B05B 11/3015* (2013.01); *B05B 11/3052* (2013.01); *B05B 11/3067* (2013.01); *A45D 2200/055* (2013.01); *A45D 2200/056* (2013.01); *B05B 11/007* (2013.01); *B05B 11/3069* (2013.01); *B05B 11/3074* (2013.01)

(58) Field of Classification Search
CPC combination set(s) only.
See application file for complete search history.

(56) References Cited

U.S. PATENT DOCUMENTS 3,118,166 A * 1/1964 Bell ..... A46B 11/002 222/376
5,536,095 A * 7/1996 Diamond ..... A47L 13/12 401/146
5,918,995 A * 7/1999 Puurunen ..... A46B 11/0058 401/146
6,065,890 A * 5/2000 Weitz ..... A47L 1/08 401/146

FOREIGN PATENT DOCUMENTS

KR 10-0903973 B1 6/2009
KR 2010-0009882 U 10/2010
KR 20-0451420 Y1 12/2010
KR 10-1242196 B1 3/2013

OTHER PUBLICATIONS

International Search Report issued in PCT/KR2014/003707 dated May 30, 2014.

* cited by examiner

*Primary Examiner* — David Walczak
(74) *Attorney, Agent, or Firm* — Marshall, Gerstein & Borun LLP

(57) ABSTRACT

A pumping-type cosmetic container having a side button, and, when pressing a button part which is positioned toward a side so as to be crossed at a right angle to a container body, a first check valve is closed while a second check valve is opened, and the contents flowing into a cylinder are discharged outward through an applicator. Therefore, with a simple structure of the pumping-type cosmetic container having a side button, a user can directly apply a fixed amount of contents to a desired region.

4 Claims, 4 Drawing Sheets

[Fig. 2]
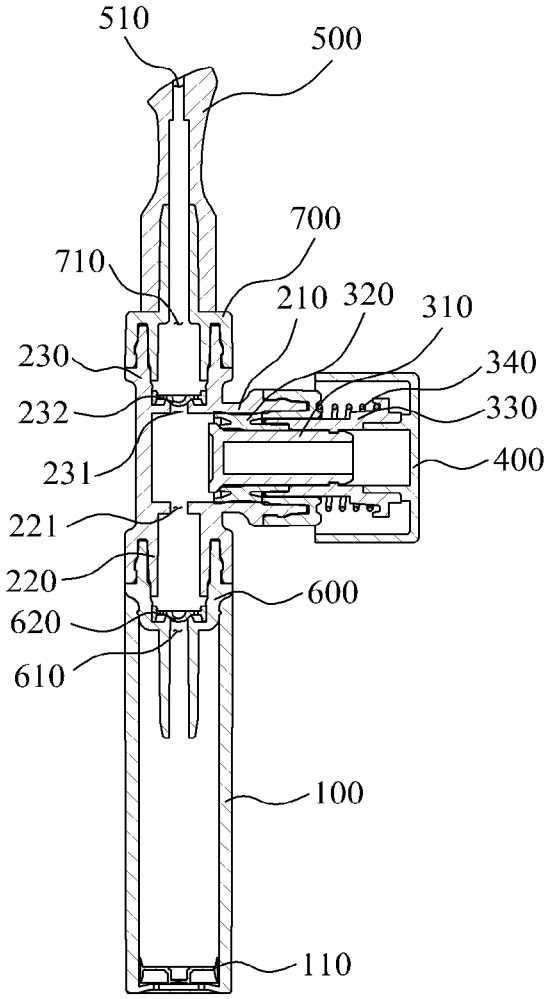

[Fig. 3]
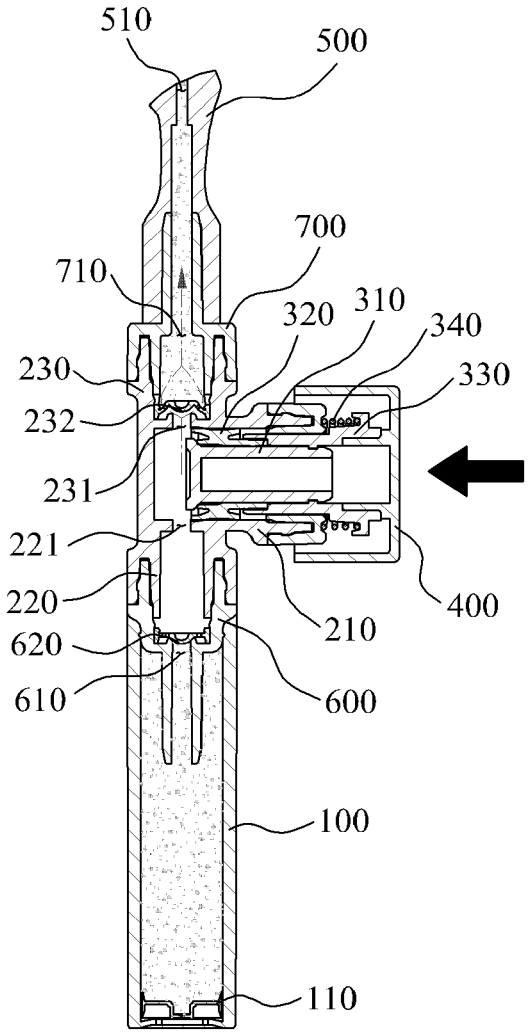

[Fig. 4]
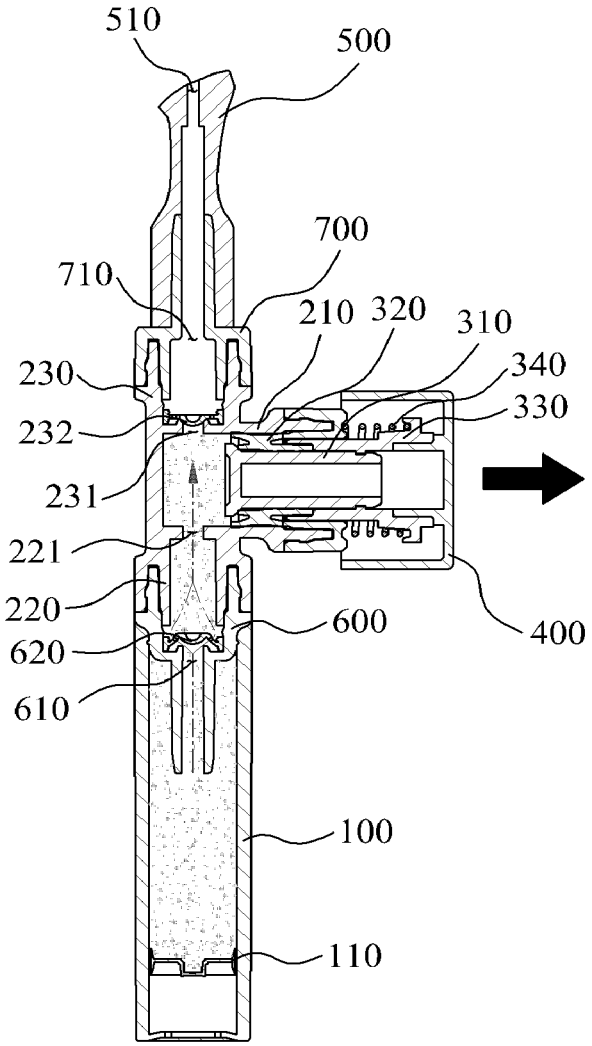

PUMPING-TYPE COSMETIC CONTAINER COMPRISING SIDE BUTTON

CROSS-REFERENCE TO RELATED APPLICATIONS

This U.S. utility patent application is a national stage application under 35 U.S.C. §371 of international application PCT/KR2014/003707, filed Apr. 28, 2014, and claims the benefit of priority under 35 U.S.C. §119 of Korean Patent Application No. 10-2013-0051047, filed May 7, 2013, the entire contents of which are hereby incorporated herein by reference for all purposes.

TECHNOLOGICAL FIELD

The present disclosure relates to a pumping-type cosmetic container having a side button, more specifically the pumping-type cosmetic container having a side button with a simple structure, wherein a pressure of an interior of a cylinder changes by a pumping movement of a pumping member when pressing a button part which is positioned toward a side to be crossed at a right angle to c container body, and thereby a first check valve is closed while a second check valve is opened, and the contents flowing into the interior of a cylinder body are discharged outward through an applicator. Therefore, through a simple structure of the pumping-type cosmetic container having a side button, a user can directly apply a fixed amount of contents to a desired region.

BACKGROUND

Generally, pumping-type cosmetic containers have a structure wherein contents are discharged by a pumping movement of a pumping member, comprising a container body where contents are contained, a pumping member which is combined to an upper portion of the container body and moves contents contained in the container body to an upper portion by a pumping movement, and a button part which is combined to an upper portion of the pumping member and delivers pressure to the pumping member by a user's pressurization, further comprising a contents discharging hole at one side for discharging contents.

Pumping-type cosmetic containers having a structure as the above, when pressurized by a user, have a pressure change in the interior of a cylinder comprised with a pumping member, and the pressure change causes the contents contained inside a container body to be discharged quantitatively. Since traditional pumping-type cosmetic containers have a structure wherein a pumping member and a button part are placed directly above the container body where contents are stored, thereby allowing contents to be discharged by the ascent and descent of a button part and causing the position of a contents discharging hole formed at a side of the button part to be changed either upward or downward; therefore, having trouble in applying contents directly onto a desired region, users have to discharge contents on their hand and then apply them onto their skin.

To solve for those drawbacks above, recently there have been developed various cosmetic containers which can discharge contents with a contents discharging hole fixed in a place.

Recently, to be able to discharge contents directly to a desired region, various cosmetic containers having a side button, wherein contents can be discharged with a contents discharging hole fixed in a place when a pumping movement is performed, are being developed.

However, traditional cosmetic containers having a side button have a pumping member placed so as to be crossed at a right angle to a passage where contents move; as a result, traditional cosmetic containers have more pressure loss than traditional pumping-type cosmetic containers which have a pumping member and a button part placed directly above a container body, thereby resulting in a problem that it is hard to discharge a fixed amount of contents due to a falling-off pumping capacity.

Accordingly, as for a pumping-type cosmetic container having a side button, there has been a variety of trial to develop a structure for constant discharge of contents, but the structure becomes so complicated that it brings users' burden due to the cost increase.

SUMMARY OF THE DISCLOSURE

The present disclosure is devised to solve the said problems above, and its goal is to provide a pumping-type cosmetic container comprising a side button, wherein an internal pressure change of a cylinder occurs by pumping a pumping member when pressing a button part, which is positioned toward a side so as to be crossed at a right angle to a container body, and thus a first check valve is closed as a second check valve is opened and the contents flowing into the cylinder are discharged outward through an applicator. Therefore, a user can directly apply a fixed amount of contents to a desired region through a simple structure.

In an embodiment, the pumping-type cosmetic container comprising a side button according to the present invention comprises a container body where contents are held; a cylinder part which is placed at an upper portion of the container body and forms a passage wherein contents moves, further comprising a cylinder body which is placed at a side so as to be crossed at a right angle to the container body, a contents inflowing tube which extends into a lower portion of the cylinder body, forming a contents inflowing hole so that the contents contained in the container body may flow into an interior of the cylinder body, a contents outflowing tube which extends into a upper portion of the cylinder body, forming a contents inflowing hole so that the contents contained in the interior of the cylinder body may flow out; a pumping member which is inserted into an interior of the cylinder body and discharges the contents by the pressure change of the interior of the cylinder body which is caused by a pumping movement; a button part which is combined to the pumping member and delivers the pressure to the pumping member by pressing action; and an applicator forming a contents discharging hole which discharges the contents flowing out through the contents outflowing hole to outside, and thereby a user can apply them on his or her skin In some embodiments, between the container body and the contents inflowing tube is equipped a valve installing tube, which forms a first contents movement hole so that the contents held in the container body flow into an interior of a cylinder body, and at the valve installing tube is installed a first check valve which opens/closes the first contents movement hole by a pumping movement of the pumping member.

In some embodiments, at the contents outflowing tube is combined a fixing tube, wherein a second contents movement hole is equipped so that contents flowing out through the contents outflowing hole can flow into a contents discharging hole.

In some embodiments, at the contents outflowing tube is equipped a second check valve which opens/closes the first contents outflowing hole by a pumping movement of the pumping member.

As described as the above, the present disclosure has an advantage wherein an internal pressure change of a cylinder occurs by pumping a pumping member when pressing a button part, which is positioned toward a side so as to be crossed at a right angle to a container body, and thus a first check valve is closed as a second check valve is opened and the contents flowing into the cylinder are discharged outward through an applicator. Therefore, a user can directly apply a fixed amount of contents to a desired region through a simple structure.

BRIEF DESCRIPTION OF THE DRAWINGS

FIG. 2 is an assembled cross-sectional view illustrating a configuration of a vacuum cosmetic container for cream type cosmetics according to an embodiment.

FIGS. 3 and 4 are constitutional views illustrating an operational state of a pumping-type cosmetic container having a side button according to an embodiment.

DETAILED DESCRIPTION

Figure 1:
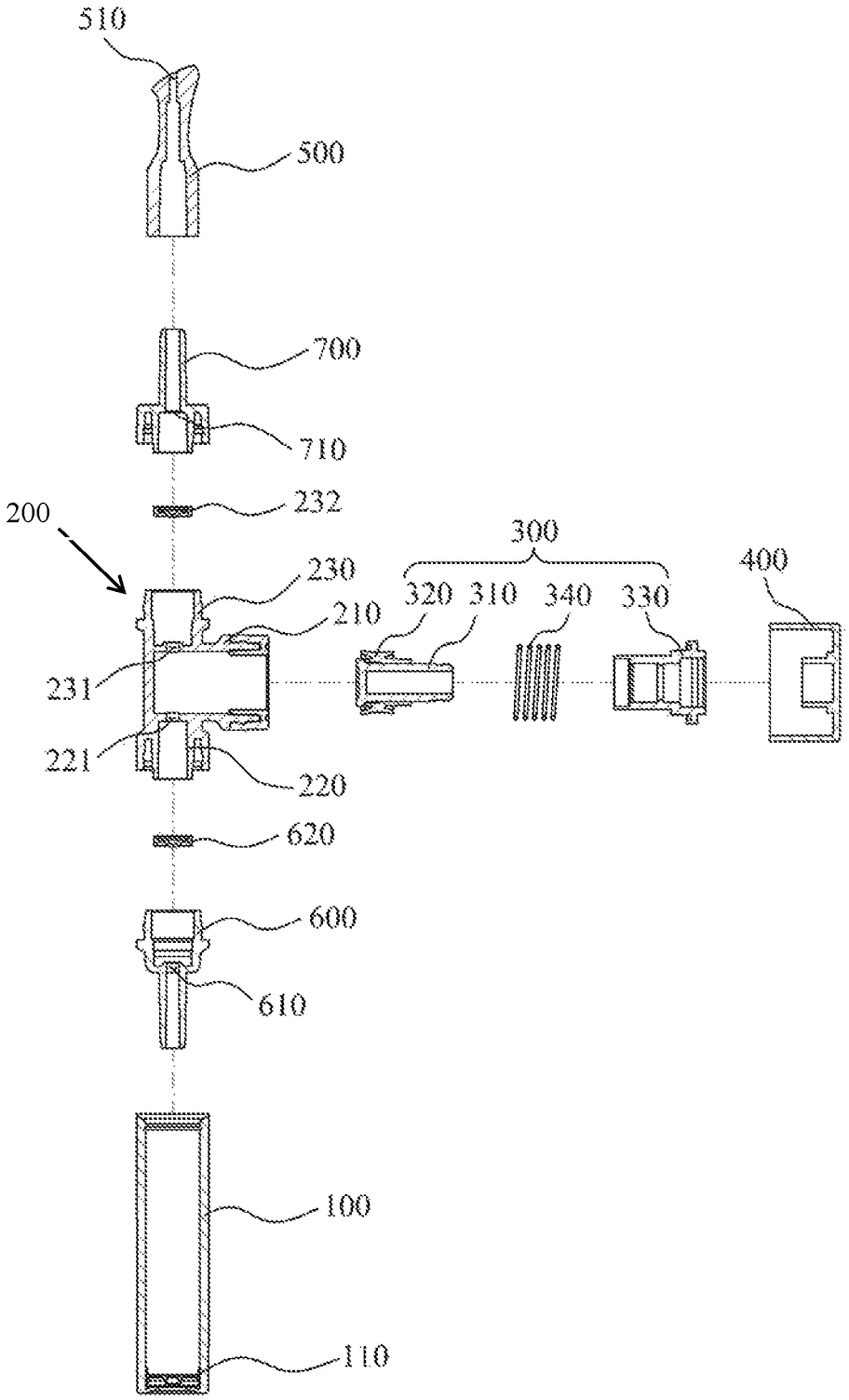
FIG. 1 is an exploded cross-sectional view illustrating a configuration of a pumping-type cosmetic container having a side button.

Hereinafter, exemplary embodiments will be described in detail with reference to the accompanying drawings. The same reference numerals provided in the drawings indicate the same members.

FIG. 1 is an exploded cross-sectional view illustrating a configuration of a pumping-type cosmetic container having a side button according to an embodiment. FIG. 2 is an assembled cross-sectional view illustrating a configuration of a pumping-type cosmetic container having a side button according to an embodiment.

Referring to FIGS. 1 and 2, a pumping-type cosmetic container having a side button according to an embodiment includes a container body 100, a cylinder part 200, a pumping member 300, a button part 400, and an applicator 500.

The container body 100 holds contents, at an inner lower portion of which a piston 110 that ascends as contents being used is installed.

At an upper portion of the container body 100 is combined a valve installing tube 600, which opens/closes an opened upper portion of the container body 100 and comprises a first contents movement hole 610 so that contents held in the container body 100 move into an interior of a cylinder body 210 when a pumping member 300 operates. It is preferred that a first check valve 620, which opens/closes the first contents movement hole 610 by a pumping movement of a pumping member 300, is equipped at the valve installing tube 600.

The cylinder part 200 is placed on a upper portion of the container body 100 and forms a passage where contents moves, further forming a cylinder body 210, a contents inflowing tube 220, and a contents outflowing tube 230.

The cylinder body 210 forms a space where a pumping member 300, which will be described later, can operate; it is featured in the present invention that the cylinder body 210 is placed toward a side so as to be crossed at a right angle to the container body 100.

By placing the cylinder body 210 toward a side so as to be crossed at a right angle to the container body 100, it is possible that a button part 400 can be equipped on a side, not on directly upward direction. Hence, when pressing a button part 400 equipped on a side, contents is discharged through an applicator 500 fixed to a fixing tube 700, thereby possible to apply contents exactly to a region where a user wants to apply contents.

The contents inflowing tube 220, which is formed extended to a lower portion of the cylinder body 210 and combined with a valve installing tube 600 which closes an upper portion of the container body 100, comprises a contents inflowing hole 221 which makes it possible for contents moving through a first contents movement hole 610 to flow into the interior of the cylinder body 210 when a first check valve 620 opens a first contents movement hole 610 by a pumping movement of a pumping member 300.

The contents outflowing tube 230 is formed, extended to an upper portion of the cylinder body 210 and supports an applicator 500, wherein at the fixing tube is equipped a contents movement hole 710 so that the contents flowing out through the content outflowing hole 231 can move to a contents discharging hole 510 of the applicator 500.

At the contents outflowing tube 230 is combined a fixing tube 700 which fixes an applicator, wherein at the fixing tube 700 a second contents movement hole 710 is equipped so that the contents flowing out through the contents outflowing hole 231 can move to a content discharging hole 510 of the applicator 500.

On the other hand, it is preferred that at an interior of the contents outflowing tube 230 is equipped a second check valve 232 which opens/closes the contents outflowing hole 231 by a pumping movement of the pumping member 300.

The pumping member 300 is inserted to an interior of the cylinder body 210 and changes inner pressure of the cylinder body 210 by a pumping movement according to pressurization of the button part 400, and thereby discharges contents, further comprising a piston rod 310 which ascends/descends inside the cylinder body 210, a seal cap 320 which moves along an inner wall of the cylinder body 210, combined encircling an outer circumferential surface of the piston rod 310 at a lower portion of the piston rod 310, a stem 330 which is combined encircling an upper portion of the piston rod 310 and fixed and installed to an inner side of the button part 400, and a spring 340 which, installed at a lower portion of the stem 330, is contracted when the button part 400 is pressed, and is relaxed and delivers elastic force when the button part 400 is released from pressurization.

The button part 400 is combined to the pumping member 300 and delivers pressure to the pumping member 300 by pressurization, and installed toward a side to be crossed with the container body 100 due to a structure of the cylinder part 200.

The applicator 500 is combined, encircling the fixing tube 700, and discharge contents to the outside, further comprising a contents discharging hole 510 so that a user can discharge contents to the outside and apply them to his or her skin.

In the following, referring to FIGS. 3 and 4, a using method of a pumping-type cosmetic container having a side button according to an embodiment will be explained. FIGS. 3 and 4 are constitutional views illustrating an operational state of a vacuum cosmetic container for cream type cosmetics according to an embodiment.

Referring to FIGS. 3 and 4, as for a pumping-type cosmetic container having a side button according to an embodiment, when a user pressurizes a button cap 400, pressuring force of a button part 400 is delivered to a stem 330, moving a piston rod 310 and a seal cap 320, and thereby performing a pumping movement of the pumping member 300; at this time, pressure change occurs, and with a first check valve closed and with a second check valve opened, the contents flowing into an interior of the cylinder body 210 will be discharged through a contents outflowing hole 231 and then pass a second contents movement hole 710 and finally move through a contents discharge hole 510 of an applicator 500 to the outside.

Next, when pressurization of a button part 400 is released, a stem 330 is restored by elastic force of a spring 340 and thereby a piston rod 310 and a seal cap 320 moves, thereby causing sucking force to occur in the interior of the cylinder part 200; therefore, a first check valve 620 is opened while a second check valve 232 is closed, thereby causing the contents held in the container body 100 to flow through a contents inflowing hole 221 into the interior of the cylinder body 210.

As described above, embodiments have been disclosed in the drawings and the specification. Although specific terms have been used herein, these are only intended to describe the presently disclosed embodiments, and are not intended to limit the meanings of the terms or to restrict the scope of the disclosure as recited in the accompanying claims. Accordingly, those skilled in the art will appreciate that various modifications and other equivalent embodiments are possible from the above embodiments. Therefore, the scope of the present invention should be defined by the technical spirit of the accompanying claims.

What is claimed is:

1. A pumping-type cosmetic container having a side button comprising:

a container body wherein contents are held;

a cylinder part, placed at an upper portion of the container body and forming a passage where the contents move, the cylinder part further comprising a cylinder body which is placed toward a side so as to be crossed at a right angle to the container body, a contents inflowing tube which is extended to a lower portion of the cylinder body, forming a contents inflowing hole which leads the contents contained in the container body to flow into an interior of the cylinder body, and a content outflowing tube which is extended to an upper portion of the cylinder body, forming a contents outflowing hole wherein the contents flowing into an interior of the cylinder body can flow out;

a pumping member which is inserted into an interior of the cylinder body and discharges the contents by changing inner pressure of the cylinder body by a pumping movement;

a button part which is combined with the pumping member and delivers pressure to the pumping member by a pressing movement; and an applicator which forms a contents discharging hole so that a user can discharge the contents through the contents outflowing hole and thereby apply the contents discharged outward onto a skin, wherein the pumping member comprises a piston rod movable in an interior of the cylinder body and a seal cap coupled to and encasing an outer circumferential surface of the piston rod, the seal cap movably contacting an inner wall of the cylinder body, the pumping member further comprising a hollow stem fixed to an inner side of the button part and coupled to the piston rod, such that the stem receives the piston rod therein and applies a pressure to the piston rod according to the pressing movement of the button part, and a spring encasing an outer circumferential surface of the stem outside of the cylinder body, wherein the spring restores the button part by providing an elastic force to the stem while being contracted when the button part is pressurized, the spring being relaxed when the button part is unpressurized, wherein the piston rod has a stroke so that an end of the piston rod moving in the interior of the cylinder body does not cover all of the contents inflowing hole and the contents outflowing hole, thereby preventing the piston rod from interfering with movement of the contents to the contents outflowing hole responsive to the pumping movement of the pumping member.

2. The pumping-type cosmetic container having a side button of claim 1, further comprising a valve installing tube between the container body and the contents inflowing tube, the valve installing tube including a first contents movement hole so that the contents held in the container body can move into the interior of the cylinder body, wherein at the valve installing tube a first check valve is installed which opens/closes the first contents movement hole by the pumping movement of the pumping member.

3. The pumping-type cosmetic container having a side button of claim 2, wherein the contents outflowing tube is equipped with a second check valve which opens/closes the contents outflowing hole by the pumping movement of the pumping member.

4. The pumping-type cosmetic container having a side button of claim 1, further comprising a fixing tube at the contents outflowing tube, the fixing tube comprising a second contents movement hole so that the contents flowing out through the contents outflowing hole can move to the contents discharging hole.

* * * * *